US009508279B2

(12) United States Patent
Yamazaki et al.

(10) Patent No.: US 9,508,279 B2
(45) Date of Patent: Nov. 29, 2016

(54) COLOR CONVERSION APPARATUS AND NON-TRANSITORY COMPUTER READABLE MEDIUM

(71) Applicant: FUJI XEROX CO., LTD., Tokyo (JP)

(72) Inventors: Chizuru Yamazaki, Yokohama (JP); Noriko Sakai, Yokohama (JP); Toshihiro Iwafuchi, Yokohama (JP); Kazuhiko Horikawa, Yokahama (JP); Makoto Fujio, Yokohama (JP); Daigo Hama, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 122 days.

(21) Appl. No.: 14/470,301

(22) Filed: Aug. 27, 2014

(65) Prior Publication Data

US 2015/0179093 A1 Jun. 25, 2015

(30) Foreign Application Priority Data

Dec. 24, 2013 (JP) ..... 2013-266034
Dec. 24, 2013 (JP) ..... 2013-266035

(51) Int. Cl.
*G09G 3/20* (2006.01)
*G09G 5/06* (2006.01)

(52) U.S. Cl.
CPC ..... *G09G 3/2003* (2013.01); *G09G 5/06* (2013.01); *G09G 2320/0666* (2013.01); *G09G 2360/145* (2013.01)

(58) Field of Classification Search
CPC .. G09G 5/02; G09G 5/06; G09G 2320/0666; G09G 2360/144; G09G 5/395; G09G 2340/10; G06T 11/001
See application file for complete search history.

(56) References Cited

U.S. PATENT DOCUMENTS

2003/0053088 A1 3/2003 Kanai et al.
2006/0071940 A1 4/2006 Ouchi
2013/0257890 A1* 10/2013 Sakai ..... G09G 5/06 345/589
2013/0293568 A1 11/2013 Sano

FOREIGN PATENT DOCUMENTS

JP Y-40-27614 9/1965
JP Y-46-32355 11/1971
JP B-49-21807 6/1974

(Continued)

OTHER PUBLICATIONS

Apr. 30, 2014 Office Action issued in Japanese Application No. 2013-266034 (with translation).

(Continued)

*Primary Examiner* — Todd Buttram
(74) *Attorney, Agent, or Firm* — Oliff PLC

(57) ABSTRACT

A conversion apparatus, includes: a target value setting unit that sets a target value for color reproduction at the time when output image data is displayed on a display device, the target value is set by using a first target value set based on a display characteristic of the display device and a second target value set by designating targets of hue and saturation with respect to a gray image; a conversion relation creation unit that creates a conversion relation based on the set target value; and an output image creation unit that performs color conversion processing on an input image data using the conversion relation to creates the output image data, in which the second target value is set to suppress variation of color representation.

11 Claims, 16 Drawing Sheets

(56) References Cited

FOREIGN PATENT DOCUMENTS

| | | |
|---|---|---|
| JP | A-62-180668 | 8/1987 |
| JP | A-6-59657 | 3/1994 |
| JP | A-2003-18416 | 1/2003 |
| JP | A-2005-286441 | 10/2005 |
| JP | A-2006-129456 | 5/2006 |
| JP | A-2006-258850 | 9/2006 |
| JP | A-2009-17473 | 1/2009 |
| JP | A-2012-151598 | 8/2012 |

OTHER PUBLICATIONS

Apr. 30, 2014 Office Action issued in Japanese Application No. 2013-266035 (with translation).

Aug. 19, 2014 Office Action issued in Japanese Application No. 2013-266034 (with translation).

* cited by examiner

: USING SECOND TARGET VALUE

: WITHOUT USING SECOND TARGET VALUE

COLOR CONVERSION APPARATUS AND NON-TRANSITORY COMPUTER READABLE MEDIUM

CROSS-REFERENCE TO RELATED APPLICATIONS

This application is based on and claims priority under 35 USC 119 from Japanese Patent Application Nos. 2013-266034 and 2013-266035, filed on Dec. 24, 2013.

BACKGROUND

Technical Field

The present invention relates to a color conversion apparatus and a non-transitory computer readable medium storing a color conversion program.

SUMMARY

According to an aspect of the present invention, it is a conversion apparatus, comprising: a target value setting unit that sets a target value for color reproduction at the time when output image data is displayed on a display device, the target value is set by using a first target value set based on a display characteristic of the display device and a second target value set by designating targets of hue and saturation with respect to a gray image; a conversion relation creation unit that creates a conversion relation based on the set target value; and an output image creation unit that performs color conversion processing on an input image data using the conversion relation to creates the output image data, wherein the second target value is set to suppress variation of color representation when the input image data indicates the gray image and color conversion processing is performed on the input image data using only the first target value.

BRIEF DESCRIPTION OF DRAWINGS

Exemplary embodiment(s) of the present invention will be described in detail based on the following figures, wherein.

DETAILED DESCRIPTION

<Explanation of Entire Configuration of Image Display System>

Hereinafter, embodiments of the present invention will be described in detail with reference to the accompanying drawings. For example, when designing various types of products, a designer may make a mock-up of the product to be designed to confirm a designed product at the time when it is manufactured as a real product. However, a manufacturing cost of a mock-up is generally easy to become expensive and a lot of labor and time are needed for manufacturing the mock-up, which is problematic.

Therefore, recently, a product is increasingly designed with CG (Computer Graphics) by using, such as a personal computer. In this case, a designer outputs an image of a product to a display device such as a small-sized liquid crystal display connected to, for example, the personal computer to design the product. However, since it is difficult to grasp an entire image of a large-sized product with the small-sized liquid crystal, the image of the product may be output using a separate display device, such as, a large-sized liquid, crystal display or projector.

As described above, when the product is designed with CG, a plurality of the display devices are frequently used. However, even when the same image data are used at the time of outputting the image of the product by the display device, a device characteristic of each display device is different. Therefore, an image outputted is normally not represented by the same color due to the difference. Further, the device characteristic is different depending on the difference of a manufacturer or model number of a product.

Furthermore, even when the devices having the same model number of the manufacturer may have a different device characteristic according to variation in manufacturing or aging. When color representation is different between the respective display devices, the designer is not able to accurately grasp the color of the product causing trouble to designing of the product.

Therefore, color representation of a plurality of the display devices are consistent with each other using an image display system 10, which will be describe below, in the present embodiment.

Figure 1:
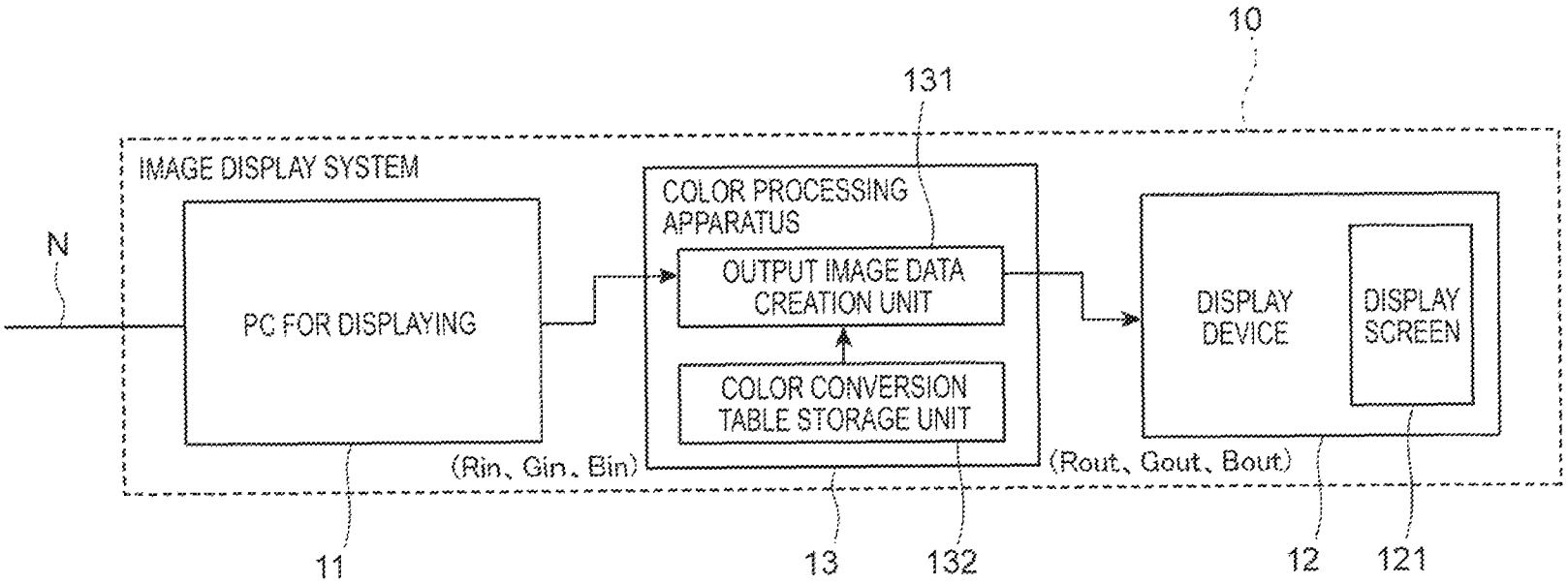
FIG. 1 is a view illustrating an exemplary configuration of an image display system according to the present embodiment.

FIG. 1 is a view illustrating an exemplary configuration of an image display system 10 according to the present embodiment. The image display system 10 includes a PC (Personal Computer) 11 for displaying which is connected to a network N to perform, for example, creation of an image information (input image data) for displaying, a display device 12 displaying an image on a display screen 121 and a color processing apparatus (color conversion apparatus) 13 which outputs the image data (output image data for displaying), which is obtained by performing a color conversion processing on the input image data inputted from the PC 11 for displaying using a color conversion table (conversion relation), to the display device 12 as an example of a color conversion module. Further, the image display system 10 is connected to, for example, an individual image display system or various printers through the network N.

In the image display system 10, the PC 11 for displaying and the color processing apparatus 13 are connected to each other through DVI (Digital Visual Interface) and the color processing apparatus 13 and the display device 12 are also connected to each other through the DVI. Further, these devices may be connected to each other through HDMI (High-Definition Multimedia Interface) or DisplayPort instead of the DVI.

The PC 11 for displaying is a so-called a general personal computer. The PC 11 for displaying 11 is adapted such that various application software are operated under the management by the OS so as to allow, for example, creation of an input image data to be performed.

Further, the display device 12 is configured by a device, for example, a liquid crystal display for PC, a liquid crystal TV or a projector, which is equipped with function of displaying an image with an additive color mixture. Accordingly, a display method in the display device 12 is not limited to a liquid crystal display method. Further, the display screen 121 is provided in the display device 12 in an example illustrated in FIG. 1. However, when a projector is utilized as the display device 12, the display screen 121 may be, for example, a screen provided outside of the display device 12.

The color processing apparatus 13 includes an output image data creation unit 131 and a color conversion table storage unit 132.

The output image data creation unit 131 performs the color conversion processing on the input image data inputted from the PC 11 for displaying using the color conversion table read from the color conversion table storage unit 132 and outputs the obtained output image data for displaying to the display device 12. Further, in the present embodiment, the output image data creation unit 131 receives each color signal ($R_{in}$, $G_{in}$, $B_{in}$) of the red (R), green (G) and blue (B) as the input image data and performs the color conversion on the color signal ($R_{in}$, $G_{in}$, $B_{in}$) to output each color signal ($R_{out}$, $G_{out}$, $B_{out}$) of the red (R), green (G) and blue (B) as the output image data. Here, the input image data and the output image data indicates data that represents each color signal of the red (R), green (G) and blue (B) by a gradation value.

The color conversion table storage unit 132 stores the color conversion table used in creation of the output image data for displaying by the output image data creation unit 131 described above. Here, the color conversion table may include, for example, an array (matrix) for conversion, one dimensional LOT (Look Up Table) or a multi-dimensional LUT, but the multi-dimensional LUT is utilized in order to more accurately perform the color conversion in the present embodiment. Further, the color conversion table storage unit 132 is configured by a non-volatile memory (e.g., flash memory) for which reading and recording are allowed and in which stored contents may be maintained even when power is not supplied.

Here, the image display system 10 in which a single display device 12 is connected to a single PC 11 for displaying through a single color processing apparatus 13 is illustrated in FIG. 1, but is not limited thereto. For example, the image display system 10 may adopt a so-called multi-monitor configuration in which a plurality of the display devices 12 are connected to a single color processing apparatus 13 to display different continuous images on each display device 12.

However, in the image display system 10 of the present embodiment, the color processing apparatus 13 other than the PC 11 for displaying perform, the color conversion processing on the input image data so as to create an output image data for displaying. Here, the color conversion table used for the color conversion processing of the color processing apparatus 13 is created in such a manner that color representation in the image display system 10 illustrated in FIG. 1 is to be consistent with that in other display device or the printer by taking into account, for example, a device characteristic (display characteristic) of the display device 12 and a device characteristic of, for example, other image display system or printer connected through the network N. Also, in the image display system 10, the creation of the color conversion table is performed by taking into account the device characteristic of the display device 12 in a state where an external color setting system is attached to the image display system 10.

Figure 2:
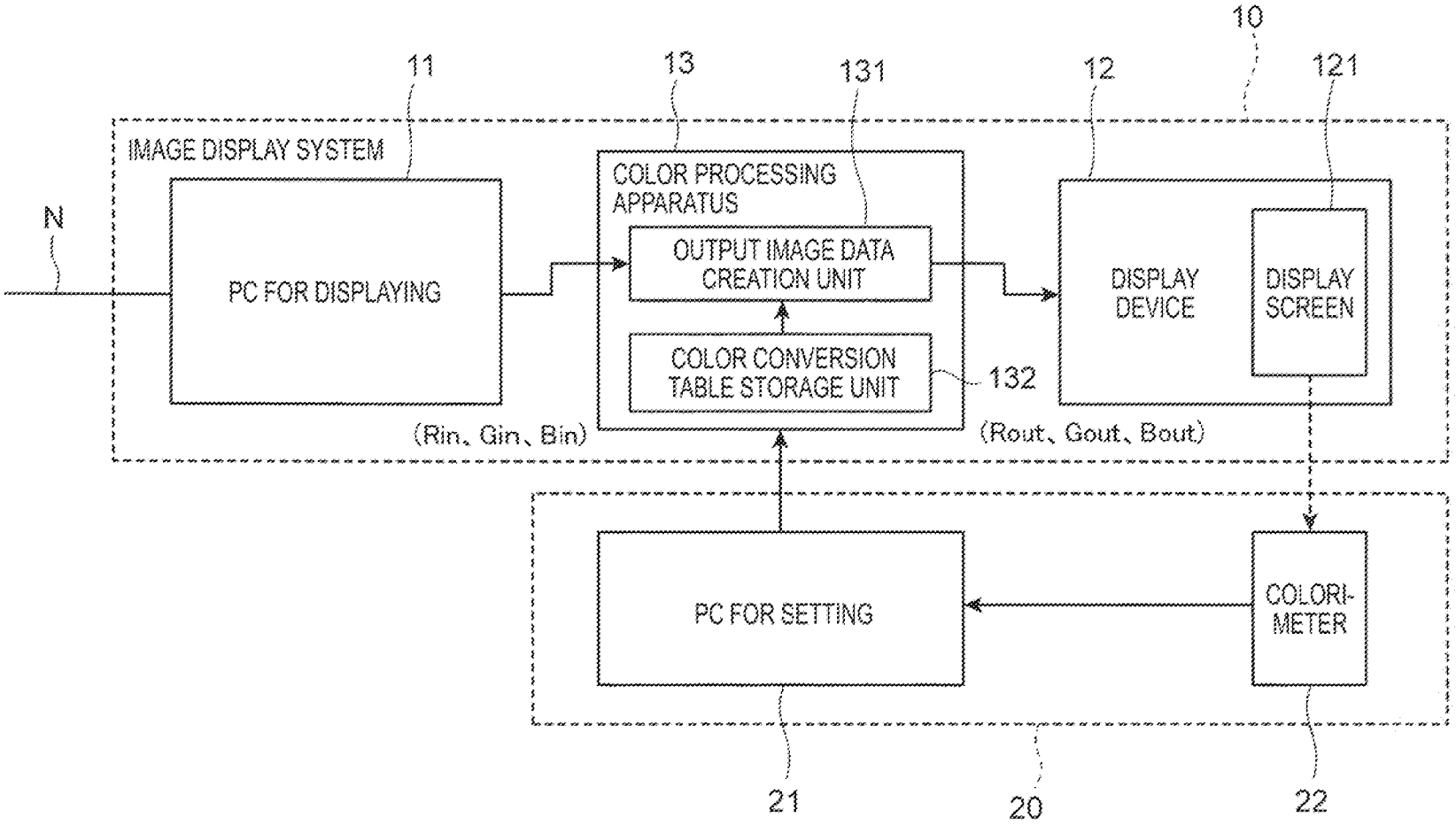
FIG. 2 is a view for explaining a state where a color setting system is attached to the image display system illustrated in FIG. 1.

Next, description will be made on the color setting system attached to the image display system 10 in creating the color conversion table used by the color processing apparatus 13. FIG. 2 is a view for explaining a state where a color setting system is attached to the image display system illustrated in FIG. 1.

The color setting system 20 of the present embodiment includes a PC 21 for setting connected to the color processing apparatus 13 of the image display system 10 and a colorimeter 22 which is connected to the PC 21 for setting and measures color of an image displayed on the display screen 121 in the display device 12 of the image display system 10.

In the color setting system 20, the PC 21 for setting is connected with a colorimeter 22 through USB (Universal Serial Bus) or RS-232C. Further, the PC 21 for setting in the color setting system 20 is connected with the color processing apparatus 13 in image display system 10 through the USB.

In the color setting system 20, the PC 21 for setting, which will be described below in detail, is a so-called general personal computer and, for example, a notebook type PC excellent in portability is used. Also, the PC 21 for setting is also adapted to operate various application software under the management by the OS.

Further, the colorimeter 22 includes a sensor which is disposed in a contact or non-contact fashion on the display screen 121 provided in the display device 12 of the image display system 10 so as to measure the color of image displayed on the display screen 121. In this example, a size of a measuring area by the sensor provided in the colorimeter 22 is set to be a size of the display screen 121 or less. Also, the colorimeter 22 is configured such that the color measurement is not performed for the entire area of the display screen 121 but for a predetermined partial area of the entire area.

Here, the color setting system 20 in which a single colorimeter 22 is connected to a single PC 21 for setting is illustrated in FIG. 2, but is not limited thereto. For example, the color setting system 20 may be configured such that a plurality of colorimeters 22 are connected to a single PC 21 for setting.

In the present embodiment, the PC 21 for setting provided in the color setting system 20 may create and record a color conversion table in the color conversion table storage unit 132 provided in the color processing apparatus 13 of the image display system 10. In the present embodiment, the PC 21 for setting may be regarded as a conversion relationship creation apparatus which creates the color conversion table used in the color processing apparatus 13.

Also, the image display system 10 of the present embodiment normally displays an image (image for display) based on the output image data for displaying, which is obtained by perforating the color conversion on the input image data created by the PC 11 for displaying with the color processing apparatus 13 in a state where the color setting system 20 is not attached, on the display screen 121 of the display device 12. In the meantime, the image display system 10 displays an image (image for colorimetry, color patch) based on the output image data of an image for colorimetry, which is selected by the PC 21 for setting, in a state where the color setting system 20 is attached, when performing creation or change of the color conversion table.

However, when the color conversion is performed by the display device 12, variation occurs in color representation at the time when the gray image is displayed on the display device 12, which may give unnaturalness to a person who views the image. Further, in the present embodiment, the "gray image" indicates a region (for example, indicates a region where lightness is in a range of 20 to 70) that a portion near black and a portion near white are excluded among an achromatic image. It is possible to determine whether the image is the gray image from whether the image is "achromatic color" or from "lightness" based on, for example, the input image data.

That is, in a case of the gray image, the input image data of the gray image becomes an image data that does not have a saturation and a hue, but a difference from a value to be taken originally occurs after the color conversion and thus an output image data of the image data may become an image data having the saturation and the hue. Also, when the output image data has saturation and hue, an image to be viewed as gray is viewed as an image to which the color occurs. The color is normally an infinitesimal abundance of color but, there is no directional property in difference of the color and thus, hue becomes scattered unevenly. Accordingly, for example, when the gray image having different lightness is displayed, the gray image is displayed by being tinged with various colors. The gray image to which the color occurs is easily recognized by a person who views the image and thus, corresponds to an image which is apt to give unnaturalness.

Figure 3A:
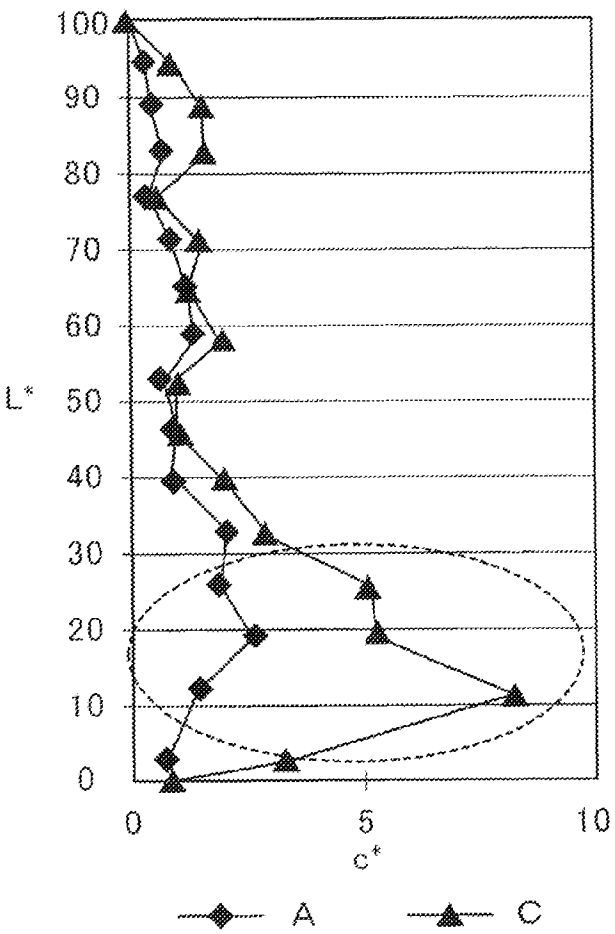
FIG. 3A and FIG. 3B are views explaining about a saturation and hue of an image actually displayed on a display device when an input image data represents a gray image.
Figure 3B:
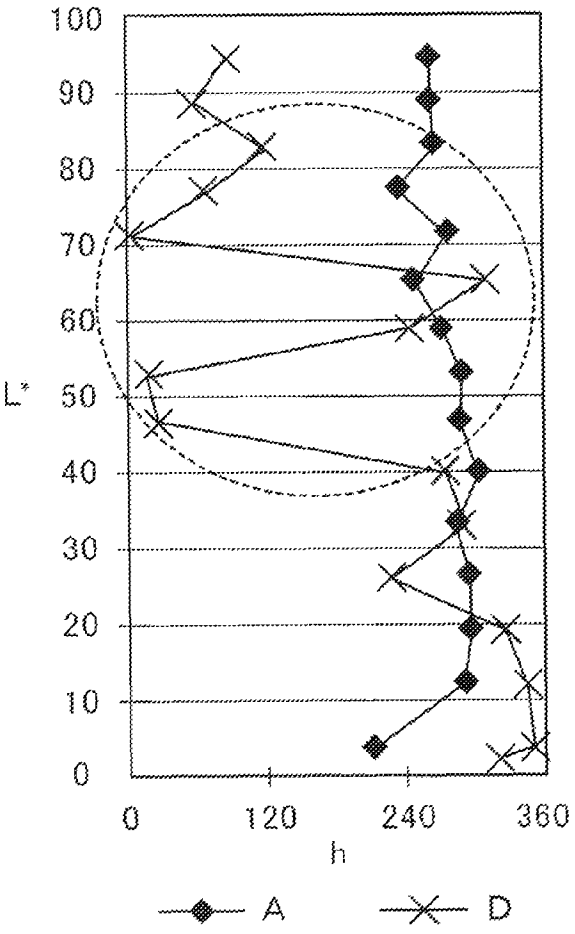

FIG. 3A and FIG. 3B are views explaining about saturation and hue of an image actually displayed on the display device 12 when the input image data represents a gray image. In FIG. 3A, the horizontal axis indicates $c^*=\sqrt{(a^{*2}+b^{*2})}$ when a color value of an image to be displayed is denoted by L*, a*, b* and the vertical axis indicates a lightness L*. Further, in FIG. 3B, the horizontal axis indicates a hue angle h and the vertical axis indicates the lightness L*. That is, change in saturation according to change in lightness may be viewed in FIG. 3A and change in hue according to change in lightness may be viewed in FIG. 3B.

FIG. 3A illustrates a relationship between the lightness and the saturation when devices denoted by "A" and "C" are used as the display device 12. Here, when the display device 12 is "A", a case where saturation c* does not change so much even when the lightness L* is changed and further the saturation c* of an image to be displayed is nearly constant with being small is illustrated. In this case, the image to be displayed is viewed as an image which slightly produces the color over the whole lightness of a region. In the meantime, when the display device 12 is "C", a case where saturation changes in a large scale in a low lightness region compared to a high lightness region when lightness is changed. This case means an image to be displayed by the display device 12 is viewed as an image which slightly produces the color in the high lightness region but viewed as an image which produces the color in a more large scale lathe low lightness region.

Further, FIG. 3B illustrates a relationship between the lightness and the hue angle when devices denoted by "A" and "D" are used as the display device 12. Here, when the display device 12 is "A", a case where the hue angle h becomes nearly constant without being changed so much near 270° even when the lightness L* is changed is illustrated. In this case, the image to be displayed by the display device 12 is viewed as an image which produces a slight blue color because the hue angle h is near 270° at the entire lightness region. In the meantime, in a case where the display device 12 is "D", a case where the hue angle h changes in a large scale in a high lightness region compared to a low lightness region, when the lightness is changed. This case means an image to be displayed by the display device 12 is viewed as an image which produces a slight blue color because the hue angle h is near 270° at the lightness region in the low lightness region but may be viewed as an image which produces a color, for example, red or green in addition to blue in the high lightness region.

Here, as illustrated in an encircled dotted past of FIG. 3A and FIG. 3B, when the gray image is displayed using the output image data by the display device 12, the saturation c* tends to be easily changed in a large scale in the low lightness region and the hue angle h tends to be easily changed in a large scale in the high lightness region.

The gray image is often used as a shadow in representing a shape of a product in the CG and has a high frequency of being used as a color of the product itself. Therefore, it is very important to suppress various colors from being produced on the gray image and make variation of color representation smaller. Accordingly, a configuration of the PC 21 for setting as that to be described below is adopted to intend to suppress the problem described above, in the present embodiment.

<Example of Hardware Configuration of PC For Setting>

Figure 4:
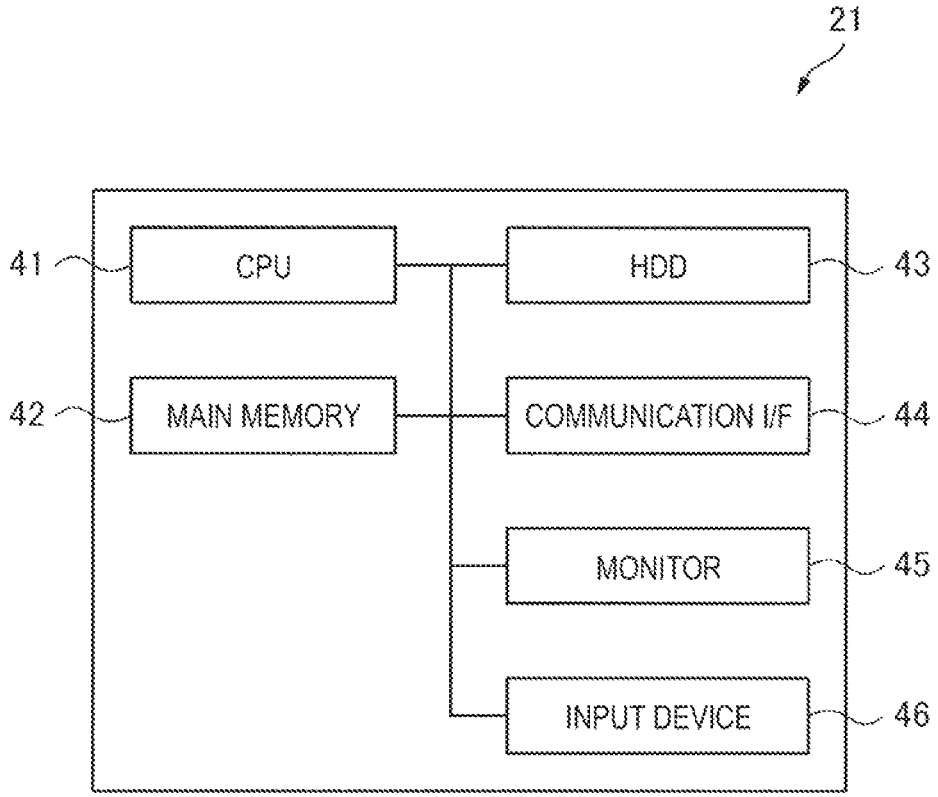
FIG. 4 is a view illustrating a hardware configuration regarding a PC for setting.

Next, a hardware configuration of the PC 21 for setting will be described. FIG. 4 is a view illustrating the hardware configuration regarding the PC 21 for setting. The PC 21 for setting is implemented by, for example, a personal computer, as described above. Also, as illustrated, the PC 21 for setting includes a CPU (Central Processing Unit) 41 which is an operation unit, a main memory 42 and a HDD (Hard Disk Drive) 43 that are storage units. Here, the CPU 41 executes various programs, such as an OS (Operating System) or application software. Further, the main memory 42 corresponds to a storage area in which various programs or data used for executing the programs and the HDD 43 corresponds to a storage area which stores, such as, input data to the various programs or output data from the various programs.

Further, the PC 21 for setting is provided with, for example, an interface for communicating with an external device (hereinafter, denoted by "communication I/F") 44, a video memory or a display and includes a monitor 45 displaying an image and an input device 46 such as a keyboard or a mouse.

Example of Functional Configuration of PC For Setting

First Embodiment

Figure 5:
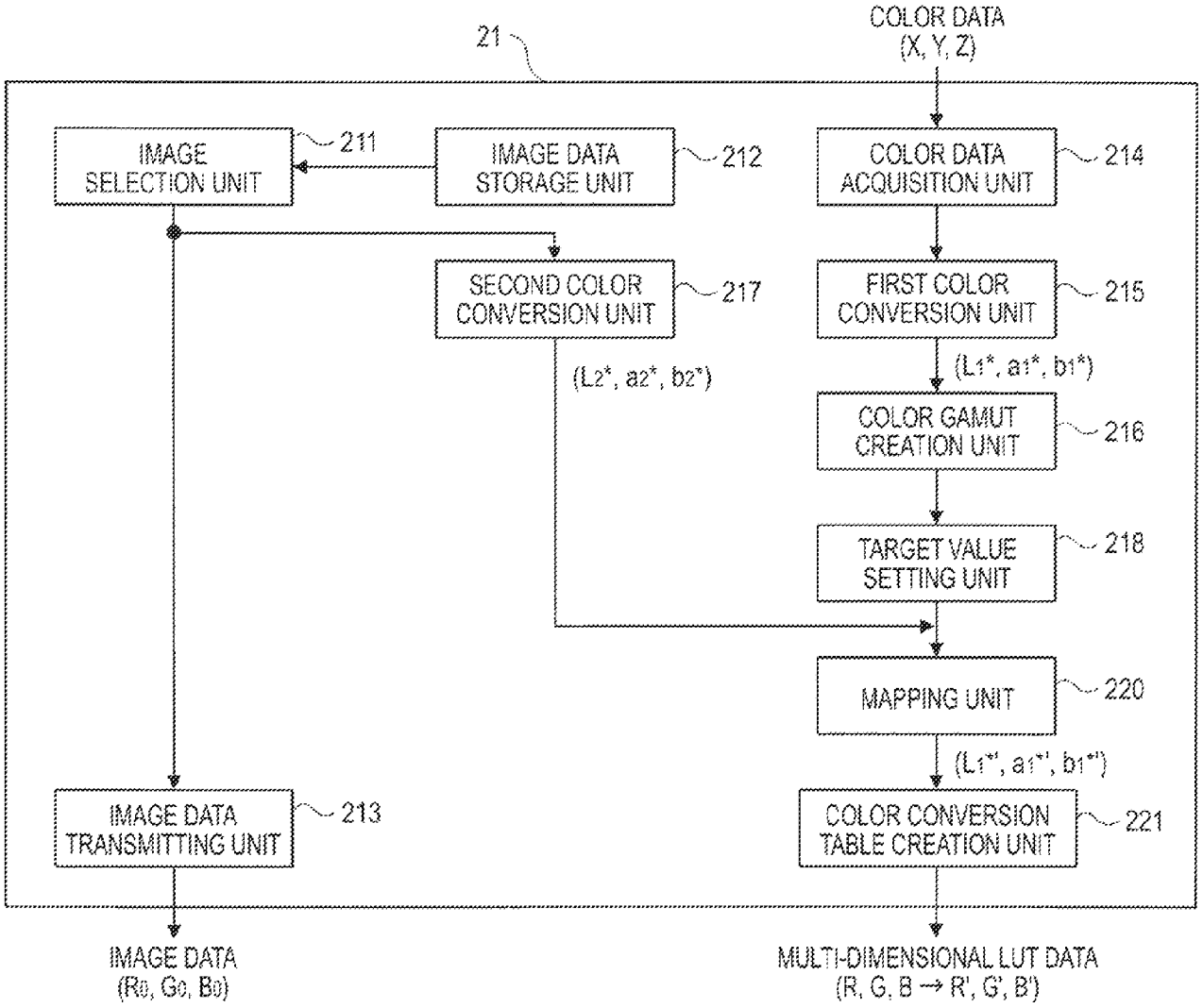
FIG. 5 is a view illustrating a functional configuration of a PC for setting according to a first embodiment.

First, description will be made on a first embodiment as the functional configuration of PC 21 for setting. FIG. 5 is a view illustrating the functional configuration of a PC 21 for setting according to the first embodiment.

The PC 21 for setting illustrated in FIG. 5 includes an image selection unit 211, an image data storage unit 212, an image data transmission unit 213, a color data acquisition unit 214, a first color conversion unit 215, a color gamut creation unit 216, a second color conversion unit 217, a target value setting unit 218, a mapping unit 220 and a color conversion table creation unit 221.

The image selection unit 211 selects an image used for performing a color adjustment of the display device 12. An image used for the color adjustment is the image for colorimetry described above. The image data storage unit 212 stores the image data (image information) of the image for colorimetry selected from the image selection unit 211. The image selection unit 211 acquires the selected image data of the image for colorimetry from the image data storage unit 212.

The image data transmission unit 213 outputs the image data of the image for colorimetry selected by the image selection unit 211 toward the display device 12 in order to perform the color adjustment of the display device 12, The image data are output as $R_0$, $G_0$, $B_0$ that are color signals of R, G and B in RGB color space.

In the display device 12, the images for colorimetry are sequentially displayed based on the image data of the image for colorimetry transmitted by the image data transmission unit 213. The color of the image for colorimetry displayed on the display device 12 is read by, the colorimeter 22. Also, the colorimeter 22 transmits color information (color data) acquired by reading each image for colorimetry to the PC 21 for setting. In this case, the color data output by the colorimeter 22 is each color value of X, Y, Z, for example, in XYZ color space.

The color data acquisition unit 214 is an example of a color information acquisition unit and acquires the color data of the image for colorimetry transmitted by the colorimeter 22 with respect to each image for colorimetry.

The first color conversion unit 215 converts the color data of the image for colorimetry acquired by the color data acquisition unit 214 into a color value of a device-independent color space. In the present embodiment, each color value of X, Y, Z in the XYZ color space used as color data of the image for colorimetry is converted into each color value of L*, a*, b* in the Lab color space. This conversion may be performed by a conventional conversion equation. Also, a correspondence relationship (first correspondence relationship) in which the color data of the image for colorimetry is associated with L*, a*, b* may be obtained, due to the conversion. Here, each color value of $L_1$*, $a_1$*, $b_1$* after the conversion is set as $L_1$*, $a_1$*, $b_1$*.

The color gamut creation unit 216 creates a color gamut which is a region of color that may be displayed by the display device 12 based on each color value of $L_1$*, $a_1$*, $b_1$* converted by the first color conversion unit 215. In the present embodiment, the color gamut is specified as a region within the Lab color space.

The second color conversion unit 217 converts the color data of the image for colorimetry selected by the image selection unit 211 into a color value of a device-independent color space. This conversion may be performed by a conventional conversion equation. In the present embodiment, each color value of R, G, B in the RGB color space used as color data of the image for colorimetry is converted into each color value of L*, a*, b* in the Lab color space. Also, a correspondence relationship (second correspondence relationship) in which the image data of the image for colorimetry is associated with L*, a*, b* may be obtained, due to the conversion. Here, each color value of $L_1$*, $a_1$*, $b_1$* after the conversion is set as $L_2$*, $a_2$*, $b_2$*.

The target value setting unit 218 sets $L_1$*, $a_1$*, $b_1$* which is a target value for color reproduction at the time when an image is displayed on the display device 12 based on each color value of the color data $L_1$*, $a_1$*, $b_1$*. Here, the target value is obtained by each color value of L*, a*, b* in the Lab color space and a first target value and a second target value are set. The first target value is set based on the device characteristic of the display device 12 and various methods have been known in regard to setting of the target value. In the present embodiment, the first target value is set based on the color gamut created by the color gamut creation unit 216 based on the color data acquired by the color data acquisition unit 214. Further, the second target value is set, separately from the first target value, by designating targets of hue and saturation with respect to the gray image and is set such that the color of the gray image displayed on the display device 12 is unified when image data to be displayed on the display device 12 contains a gray image.

Figure 6:
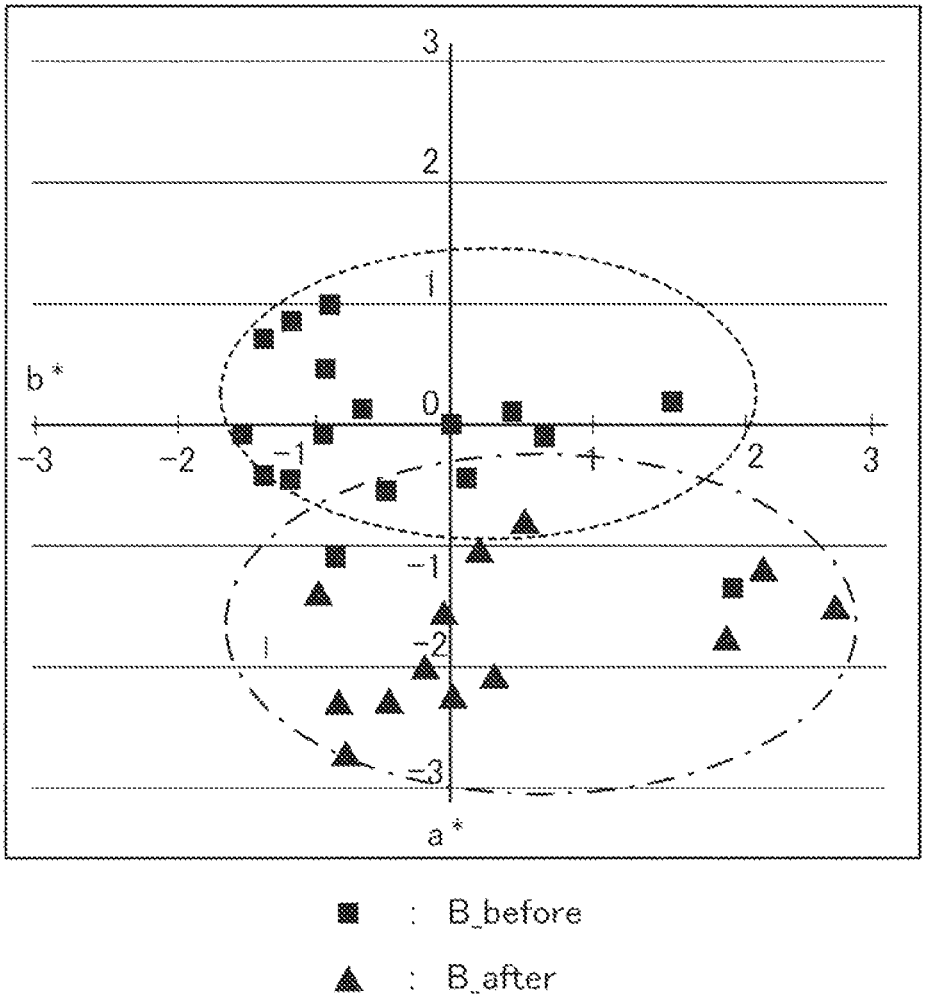
FIG. 6 is a view explaining about a color data actually displayed on the display device 12 for a case where a target value (a second target value) of hue and saturation is not set and for a case where the second target value is set, when the image data to be displayed on the display device contains a gray image.

FIG. 6 is a view explaining about color data actually displayed on the display device 12 for a case where a target value (a second target value) of hue and saturation is not set and for a case where the second target value is set when the image data to be displayed on the display device 12 contains the gray image. Here, the horizontal axis is set to indicate b* and the vertical axis is set to indicate a* and distribution of the color data of the gray image actually displayed on the display device 12 is illustrated. Among the distribution, respective points of "B_before" are points for a case where the second target value is not set. That is, this case corresponds to a case where the target value is only based on the device characteristic of the display device 12. In other words, it may be described that the respective points of "B_before" are color data actually displayed on the display device 12 for a case where the color data is also converted using only the first target value without using the second target value even when the image data to be displayed on the display device 12 is the gray image. Further, it may be described that the respective points of "B_before" are the color data, actually displayed on the display device by the conventional method.

In FIG. 6, the origin where a*=b*=0 is a portion where the hue and the saturation are not produced. However, the color data illustrated by the respective points of "B_before" are distributed within a relatively narrow range (generally within a range illustrated by an encircled dotted line) centered about the origin. That is, this color data has the hue and the saturation, and further, becomes to have various colors when being displayed as an image. That is, in FIG. 6, when the color data exists in a domain of the first quadrant, the color data become an image in which red color is produced. Similarly, when the color data exists in a domain of the second quadrant, the color data become an image in which green color is produced and further, when the color data exists in a domain of the third quadrant or the fourth quadrant, the color data become an image in which blue color is produced.

Therefore, in the present embodiment, when the image data to be displayed on the display device 12 contains the gray image, the second target value is set in such a manner that an average of the saturation of the gray image group displayed on the display device 12 is larger than 0 (zero) and variation in the hue angle between the gray image groups is restricted to be fallen within 180 degrees. Here, the "gray image group" refers to a set of a plurality of the gray images displayed on the display device 12 and the average of the saturation of the gray image group is obtained by calculating an average of a plurality of saturation values from the saturation value (saturation value $c^*=\sqrt{(a^*{}^2+b^*{}^2)}$) of each of the plurality of the gray images displayed on the display device 12. Further, variation in the hue angle between the gray image groups is obtained as a range of angle in which a plurality of the hue angles are distributed from a value (hue angle) indicating hue of each of the plurality of the gray images displayed on the display device 12. Further, the second target value is desirably set to move the color data such that the color data is restricted to be fallen within one of three domains of the first quadrant (first region in which the hue angle is 0 degree to 90 degrees), the second quadrant (second region in which the hue angle is 90 degrees to 180 degrees) and the third quadrant and the fourth quadrant (third region in which the hue angle is 180 degrees to 360 degrees). That is, in other words, it may be described that the target value setting unit 218 sets the second target value such that the color of the gray image to be displayed on the display device 12 becomes one of red, green and blue when the image data to be displayed on the display device 12 contains the gray image.

In the example of FIG. 6, the second target value falls within the domain of the third quadrant, and the fourth quadrant (in this case, generally within a range illustrated by an encircled alternated long and short dashed line) and the color data after the conversion using the second target value are illustrated by the respective points of "B_after". The color data illustrated by the respective points of "B_after" have the hue and the saturation but become an image on which the color of blue, which is a single color, is produced without having various colors. That is, in this case, the color of the image to be displayed is unified when the image data containing the gray image is displayed on the display device 12. In this case, it is desirable that the hue is restricted to be fallen within a predetermined range described above and a range in which the hue (angle) vanes is made smaller.

The second target value may be set, for example, as in the following description.

Figure 7B:
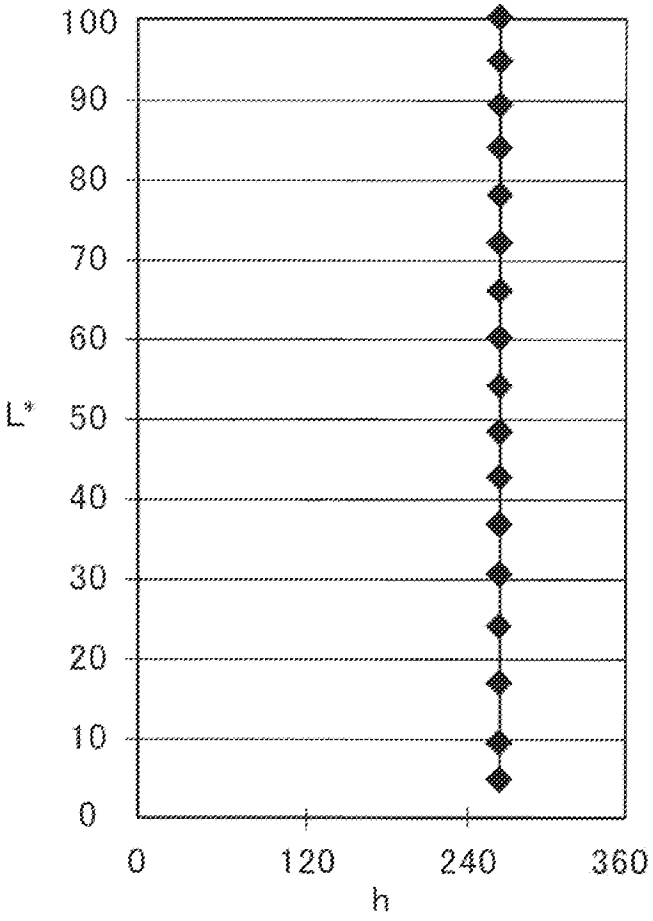
FIG. 7A and FIG. 7B are views explaining about the second target value.
Figure 7A:
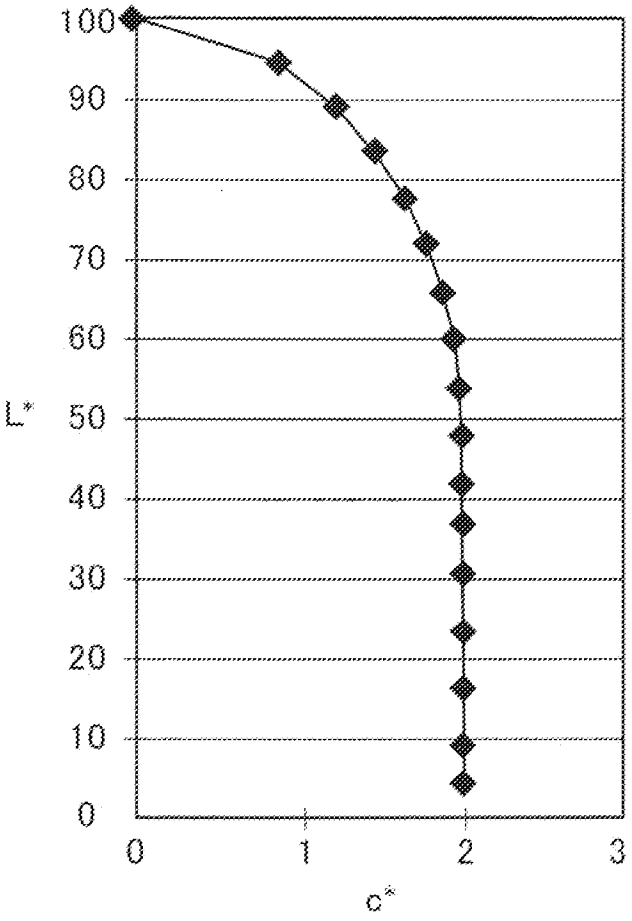

FIG. 7A and FIG. 7B are views explaining about a second target value. FIG. 7A illustrates about the saturation set as the second target value. In FIG. 7A, the horizontal axis indicates saturation c* and the vertical axis indicates lightness L*. Here, saturation is defined as $c^*=\sqrt{(a^*{}^2+b^*{}^2)}$. Further, the saturation is changed by lightness L*as illustrated. In this case, the saturation c* is set to 0 (zero) first when the lightness L* is 100 at maximum, that is, on the basis of a case where an image to be displayed is white. Also, the saturation c* is made larger as the lightness L* becomes smaller. The saturation c* is set to 2 (two) when the lightness L* is 50 (fifty) or less.

Further, FIG. 7B illustrates the hue angle set as the second target value, in FIG. 7B, the horizontal axis indicates the hue angle h and the vertical axis indicates the lightness L*. In this case, the hue angle h is not changed as the lightness L* increases and a target of the hue angle h is set to a direction of 270°. That is, in a case where the setting of the hue angle is applied to FIG. 6, the respective points of "B_before" moves to generally right downward and the color data after having been moved are distributed in a region where the blue color, which is illustrated by the respective points of "B_before", is produced. In the example of FIG. 7A and FIG. 7B, the second target value is designated as a value of the saturation and the hue angle, and the saturation c* is designated as a value larger than 0 (zero) and the identical hue angle h is designated with respect to the color data of the gray image group having different lightness. Further, the value of the saturation c* is designated to be increased from a first value of lightness (in this case, lightness L*=100), which becomes the maximum in lightness, toward a second value of lightness (in this case, lightness L*=50) which is smaller than the first value of lightness.

The saturation c* and the hue angle h may be set as a predetermined fixed value, but may be desirably changed by the distribution of the color data of the image for colorimetry.

Specifically, the following methods (1) to (4) may be exemplified.

(1) An user makes visual determination on the distribution of the color data of the gray image group displayed on the display device 12 to input and set the saturation c* and the hue angle h.

(2) The saturation c*and the hue angle h are obtained by using the distribution in which the color data exist (For example, the distribution illustrated by the respective points of "B_before" in FIG. 6) on the a*b*-coordinate plane illustrated in FIG. 6. That is, the saturation c* and the hue angle h are set at a portion and range in which the color data are distributed.

(3) The color data of the origin a*=b*=0 (User set a plurality of values of L*) in the a*b*-coordinate plane is converted into the color value of R, G, B using the second correspondence relationship. Further, the color value of R, G, B is recovered to the color value of L*, a*, b* using again the second correspondence relationship. In this case, the calculated value has a difference compared to first color value (a*=b*=0) and thus, is distributed in a relatively narrow range centered around the origin (a*=b*=0). This distribution indicates a distribution having the same tendency as the color data $L_1^*$, $a_1^*$, $b_1^*$ obtained by actually measuring the image for colorimetry and thus, the saturation c* and the hue angle h may be set based on the calculated value.

(4) A region to which the color data is to be moved is changed by color temperature of the display device 12. For example, when the color temperature of the display device 12 is relatively high, the second target value is set to be fallen in the domain of the third quadrant or the fourth quadrant at which the color having blue is produced and the saturation c* and the hue angle h are set for setting the second target value. Further, when the color temperature of the display device 12 is relatively low, the second target value is set to be fallen in the domain of the first quadrant at which the color having red is produced and the saturation c* and the hue angle h are set for setting the second target value. However, in general, the second target value setting, which causes the blue color to be produced, has a tendency to make a person who views the gray image more difficult to feel unnaturalness.

Referring back to FIG. 5, the mapping unit 220 converts the color gamut occupied by the input image data as the region which may be displayed by the display device 12 into the color gamut created by the color gamut creation unit 216 based on the target value on the Lab color space set by the first target value and the second target value. Various methods of conversion (compression) of the color gamut from the space of input device to the space of output device have been known as in the description of setting of the first target value. That is, a conversion process in which the color data $L_1$*, $a_1$*, $b_1$* of the image for colorimetry is converted into the target value $L_1$*, $a_1$*, $b_1$*, on the Lab color space set by the first target value and the second target value is performed in the mapping unit 220.

The color conversion table creation unit 221 compares the color data $L_1$*, $a_1$*, $b_1$*, after the conversion in the mapping unit 220 with $L_2$*, $a_2$*, $b_2$* converted by the second color conversion unit 217 and convert the color data $L_1$*, $a_1$*, $b_1$*, after the conversion in the mapping unit 220 into each color value of R, G, B in tire RGB color space using the second correspondence relationship. Here, each color value of R, G, B after the conversion is denoted by R', G', B', respectively.

Also, the color conversion table creation unit 221 creates a color conversion table which converts the color of the image displayed by the display device 12. In the present embodiment, the color conversion table is the multi-dimensional LUT as described above. Here, the color conversion table creation unit 221 functions as a creation unit which creates a conversion relationship used at the time when the image data is color-converted into the image to be displayed on the display device 12.

The multi-dimensional LUT is a table in which color signals of $R_0$, $G_0$, $B_0$ are converted into color signals of R', G', B'. However, as each color value of $R_0$, $G_0$, $B_0$, the image data of the image for colorimetry is not directly used but lattice points of the multi-dimensional LUT are used.

Also, since the multi-dimensional LUT is an LUT in which the first target value set by the target value setting unit 218 is reflected, the LUT is created to be fallen within a range of the color gamut created by the color gamut creation unit 216 when the input image data ($R_{in}$, $G_{in}$, $B_{in}$) is color-converted to the output image data, ($R_{out}$, $G_{out}$, $B_{out}$) by using the multi-dimensional LUT. Further, since the multi-dimensional LUT is an LUT which is created by reflecting the second target value set by the target value setting unit 218, the gray image actually displayed on the display device 12 becomes an image which has a hue and of which color is unified when the input image data ($R_{in}$, $G_{in}$, $B_{in}$) is color-converted to the output image data ($R_{out}$, $G_{out}$, $B_{out}$) using the multi-dimensional LUT.

Figure 8:
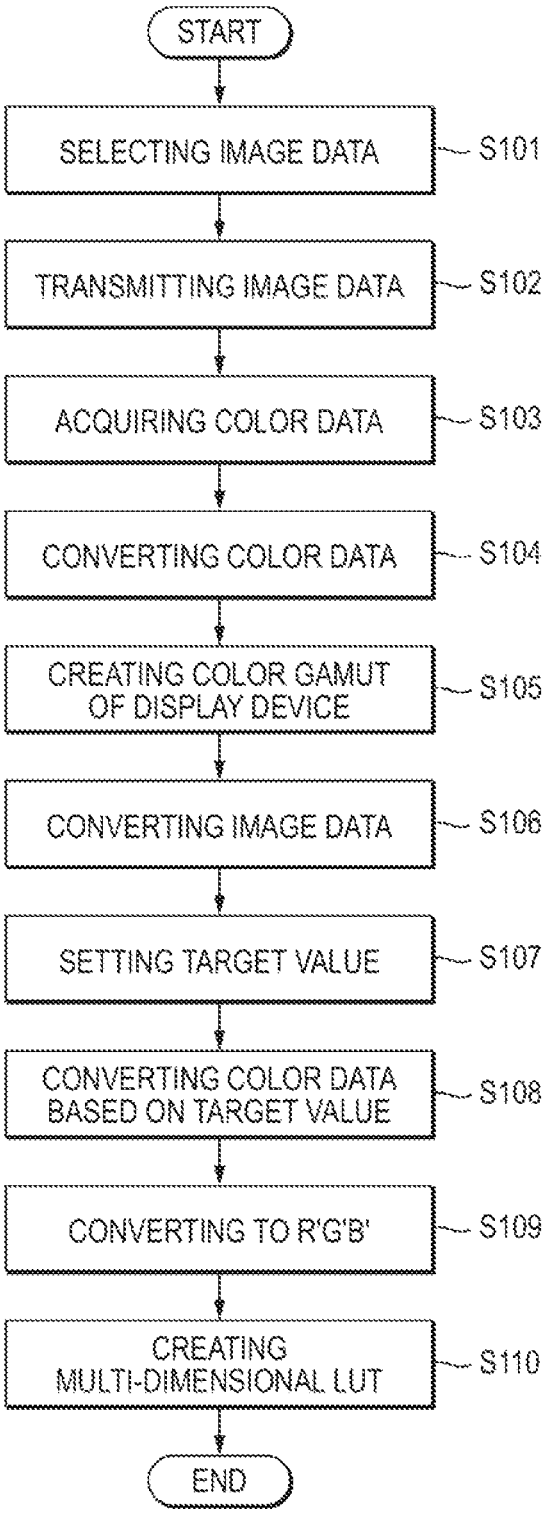
FIG. 8 is a flowchart explaining about operations of the PC for setting.
Figure 9:
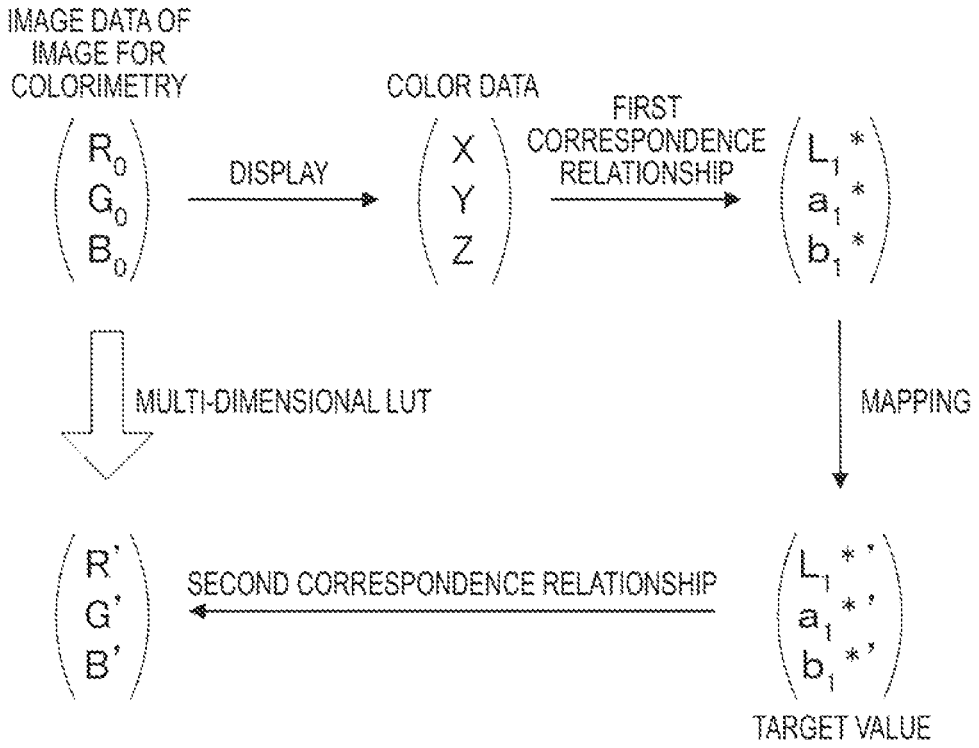
FIG. 9 is a view conceptually illustrating a procedural process in which a color value is converted.

Next, operations of PC 21 for setting in the present embodiment will be described. FIG. 8 is a flowchart explaining about the operations of the PC 21 for setting. Further, FIG. 9 is a view conceptually illustrating a procedural process in which a color value is converted. Hereinafter, the operations of the PC 21 for setting will be described using FIG. 5, FIG. 8 and FIG. 9.

First, the image selection unit 211 selects the image for colorimetry used for performing the color adjustment of the display device 12 and acquires the image data of the image for colorimetry from the image data storage unit 212 (step 101).

Next, the image data transmission unit 213 sequentially transmits the image data of the image for colorimetry selected from the image selection unit 211 to the display device 12 (step 102).

The image data are the color signals of $R_0$, $G_0$, $B_0$. The image for colorimetry is sequentially displayed on the display device 12.

A color of the displayed image for colorimetry is read by the colorimeter 22 and the colorimeter 22 transmits the color data as the result of color measurement to the PC 21 for setting. The color data becomes each color value of X, Y, Z.

The color data is acquired by the color data acquisition unit 214 (step 103). Next, the first color conversion unit 215 converts each color value of X, Y, Z, which is the color data of the image for colorimetry, into each color value of $L_1$*, $a_1$*, $b_1$* (step 104). Accordingly, the first correspondence relationship may be obtained. Also, the color gamut creation unit 216 creates the color gamut which is a color gamut that may be displayed by the display device 12 (step 105).

In the meantime, the second color conversion unit 217 converts each color value of $R_0$, $G_0$, $B_0$ which is the image data of the image for colorimetry, into each color value of $L_2$*, $a_2$*, $b_2$ (step 106). Accordingly, the second correspondence relationship may be obtained.

Next, the target value setting unit 218 sets the saturation c* and the hue angle h, that are the first target value and the second target value, as the target value (step 107). Accordingly, the target values $L_1$*, $a_1$*, $b_1$* for color reproduction in the Lab color space when displaying the image on the display device 12 are obtained.

Next, the mapping unit 220 converts each color value of $L_1$*, $a_1$*, $b_1$* as the color data of the image for colorimetry into $L_1$*, $a_1$*, $b_1$*, that are the color data based on the target value (step 108). Accordingly, a processing of converting the color gamut occupied by the input image data into the color gamut which is a region that may be displayed by the display device 12 is performed.

Also, the color conversion table creation unit 221 compares $L_1$*, $a_1$*, $b_1$*, with $L_2$*, $a_2$*, $b_2$* and further, converts $L_1$*, $a_1$*, $b_1$*, into each color value of R', G', B' using the second correspondence relationship (step 109).

Further, the color conversion table creation unit 221 creates the multi-dimensional LUT as a color conversion table which, converts a color of image to be displayed by the display device 12 (step 110).

Data of the created multi-dimensional LUT are stored as each lattice point data of a multi-dimensional LUT as the multi-dimensional LUT to be stored in the color conversion table storage unit 132 (see, FIG. 1) of the color processing apparatus 13. $R_{in}$, $G_{in}$, $B_{in}$ as the input image data may be converted into $R_{out}$, $G_{out}$, $B_{out}$ as the output image data by the multi-dimensional LUT.

Figure 10A:
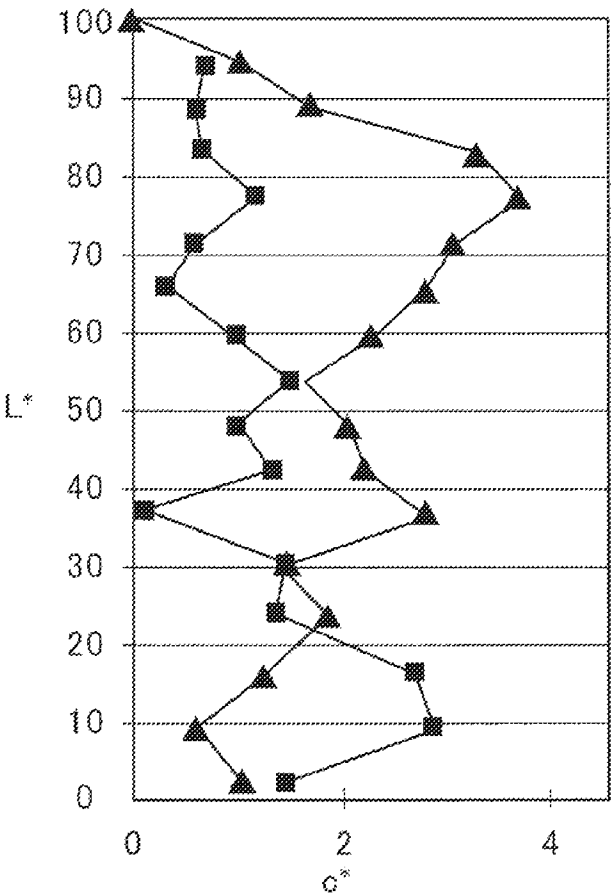
FIG. 10A and FIG. 10B are views in which a case where a gray image is converted by a mapping unit using the second target value in addition to the first target value is compared with a case where the gray image is converted by the mapping unit using only the first target value without using the second target value, when an gray image is included in the image data to be displayed on the display device.
Figure 10B:
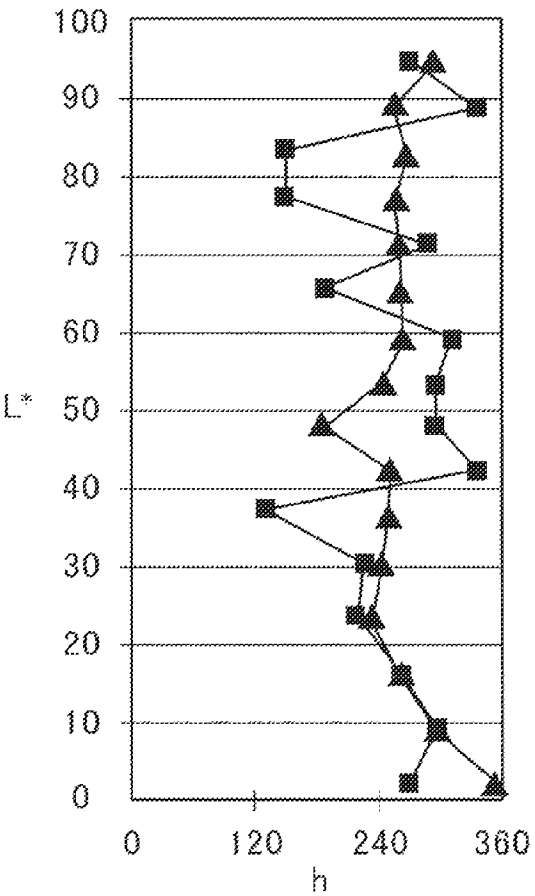

FIG. 10A and FIG. 10B are views in which a case where a gray image is converted by a mapping unit using the second target value in addition to the first target value is compared with a case where the gray image is converted by the mapping unit 220 using only the first target value without using the second target value, when an gray image is included in the image data to be displayed on the display device 12. FIG. 10A illustrates a relationship between lightness and saturation. Here, the horizontal axis indicates saturation c* and the vertical axis indicates lightnessL*. Further, FIG. 10B illustrates a relationship between lightnessL* and the hue angle. Here, the horizontal axis indicates the hue angle h and the vertical axis indicates the lightnessL*.

As illustrated, a case where the second target value is set causes variation in the hue angle h between the gray image groups having different lightnessL* to be fallen into a predetermined range compared to a case where the second target value is not set.

Second Embodiment

Figure 11:
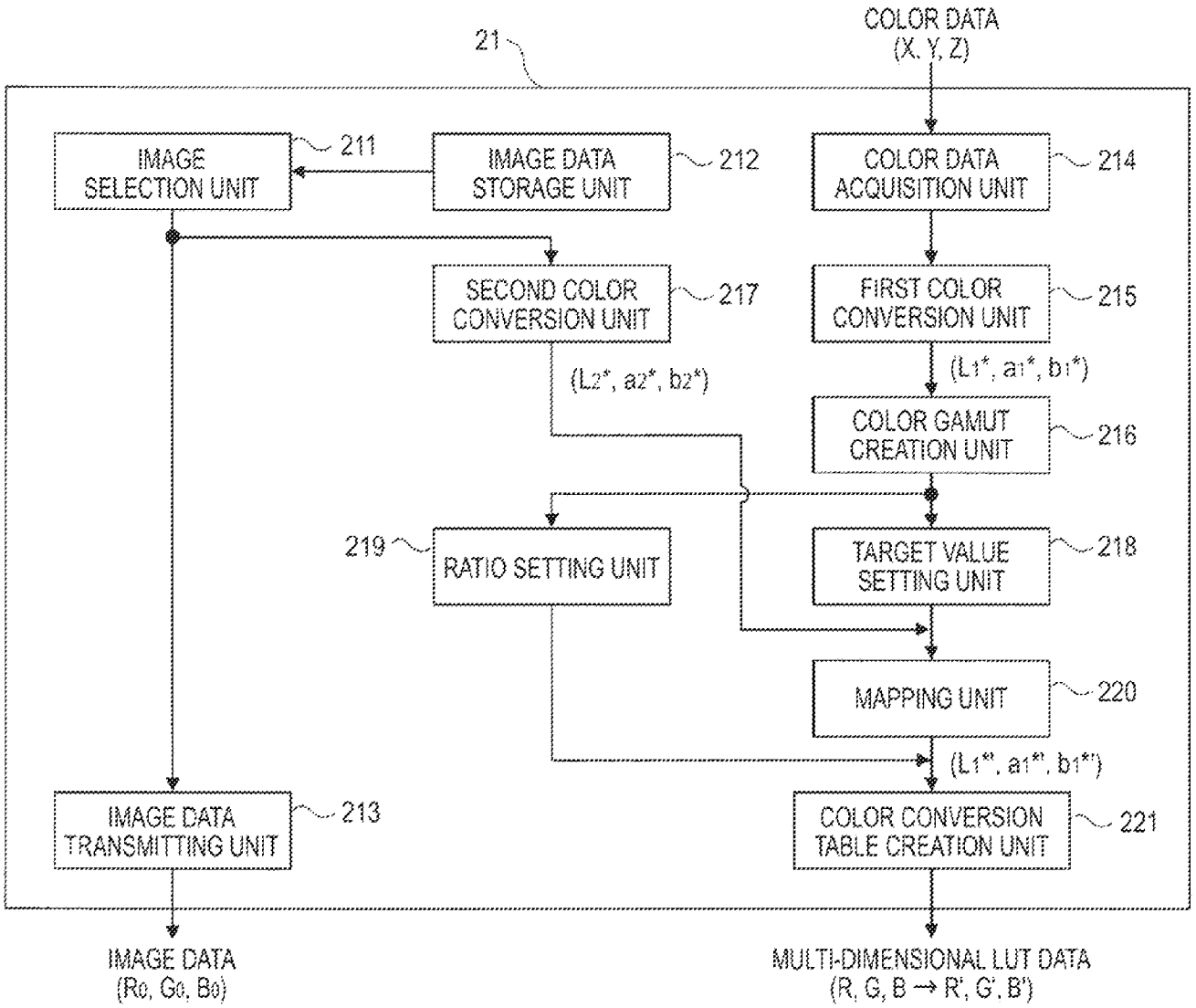
FIG. 11 is a view illustrating a functional configuration of a PC for setting according to a second embodiment.

Next, description will be made on a second embodiment as the functional configuration of PC 21 for setting. FIG. 11 is a view illustrating a functional configuration of the PC 21 for setting according to the second embodiment.

The PC 21 for setting illustrated in FIG. 11 includes the image selection unit 211, the image data storage unit 212, the image data transmission unit 213, the color data acquisition unit 214, the first color conversion unit 215, the color gamut creation unit 216, the second color conversion unit 217, the target value setting unit 218, a ratio setting unit 219, the mapping unit 220 and the color conversion table creation unit 221.

The PC 21 for setting Illustrated in FIG. 11 is different from the PC 21 for setting illustrated in FIG. 5 in that the ratio setting unit 219 is further added. Further, other functional units of the PC 21 for setting illustrated in FIG. 11 have the same functional units of the PC 21 for setting illustrated in FIG. 5, except for the target value setting unit 218 and the color conversion table creation unit 221. Accordingly, the target value setting unit 218, the ratio setting unit 219 and the color conversion table creation unit 221 will be described in the following, as the second embodiment.

The target value setting unit 218 sets the target, value $L_1$*, $a_1$*, $b_1$*, for color reproduction when displaying an image on the display device 12 based on each color value of the color data $L_1$*, $a_1$*, $b_1$*, as in the first embodiment. However, one kind of the first target value is set as the target value in the present embodiment. That is, a first target value which is set based on a device characteristic of the display device 12 is set as the target value, but a second target value which is set by designating targets of the hue and saturation with respect, to the gray image is not set.

The ratio setting unit 219 determines the color signal ratio of the value of the image data of other basic colors at the time when one of a plurality of basic colors used when displaying the image by the display device 12 is set as a reference in order to cause the color of the gray image displayed on the display device 12 to be unified, based on the hue and saturation obtained from the color data of the gray image acquired by the color data acquisition unit 214. In this case, the basic color is a single color which corresponds to each of red (R), green (G) and B (blue).

In the present embodiment, similarly as in FIG. 6, the color signal ratio used for increasing and decreasing the each value of the color signals of red (R), green (G), B (blue) that are the basic colors in order to cause the color data to be fallen within one of three domains of the first quadrant, the second quadrant and the third quadrant and the fourth quadrant.

Figure 12:
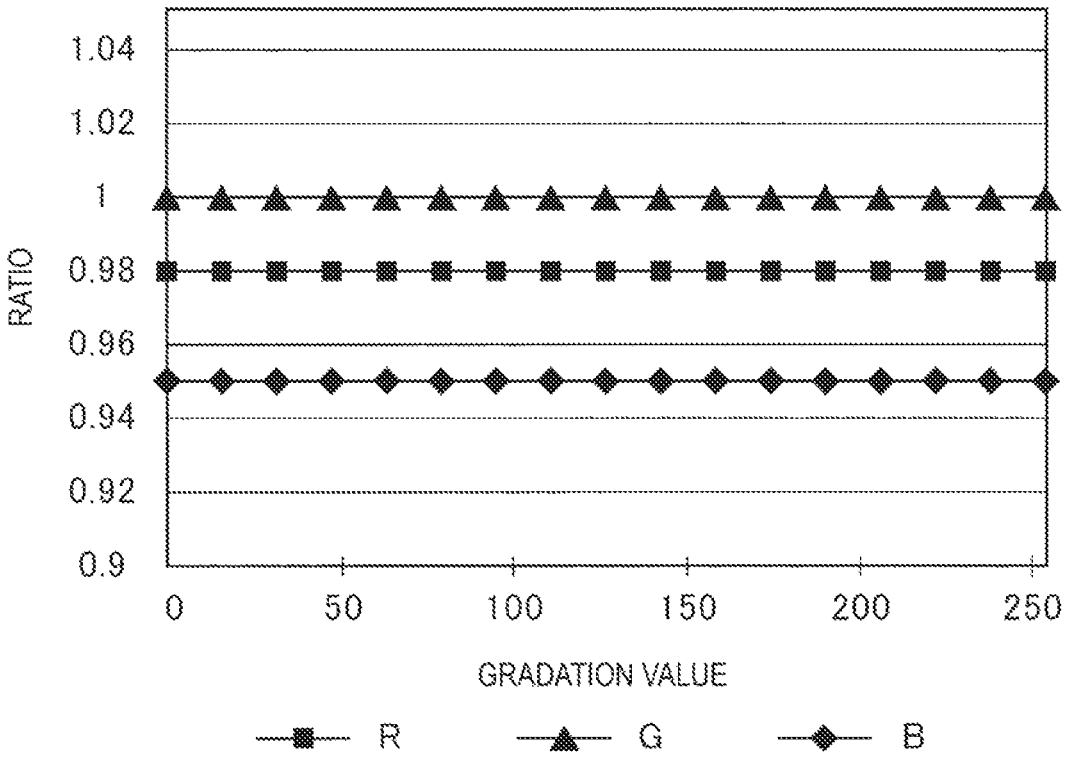
FIG. 12 is a view explaining about a color signal ratio set by a ratio setting unit.

FIG. 12 is a view explaining about a color signal ratio set by the ratio setting unit 217. Here, the horizontal axis is the gradation value of the color signal of R, G, B. Further, the vertical axis indicates a color signal ratio to be set. In FIG. 12, the color signal of G which is one of a plurality of basic colors is set as a reference. Also, the values to be taken by the color signals of R and 8 that are other basic colors when the color signal of G is set to 1 (one) is indicated as a ratio. In this example, the ratio of the R color signal to the G color signal is set to 0.98 irrespective of the gradation value and the ratio of the B color signal to the G color signal is set to 0.95 irrespective of the gradation value. As described above, the values (in this example, 0.98, 0.95) to be taken by the color signals of other two basic colors, when the color signal of one basic color (this is referred to as a reference color) among the respective color signals composed of each basic color of R, G, B is set to 1 (one), is referred to as a ratio (hereinafter, simply referred to as "ratio") of the color signal of other basic colors to the color signal of the reference color. Further, similarly, a ratio of the color signal of other basic colors to a value of 1 (one) of the reference color is also referred to as the "ratio" for convenience. Further, it is assumed that a set of values each of which representing each basic color of R, G, B in a "ratio" is also referred to as a "color signal ratio". In this example, the "color signal ratio" may be represented by 1.00:0.98:0.95. Accordingly, the ratio setting unit 219 functions as a setting unit which sets a color signal ratio other than 1:1:1 as the color signal ratio of a plurality of basic colors used when displaying the image by the display device 12. In this case, the color signal ratio is other than 1:1:1 irrespective of lightness of the gray image and further becomes the same value.

As described above, the value of color signal of R, G, B is increased based on the color signal ratio and thus the color of the image displayed by the display device 12 is changed. Accordingly, as illustrated in FIG. 6, a color data may be restricted to be fallen within one of three domains of the first quadrant, the second quadrant and the third quadrant and the fourth quadrant. Further, the basic color as the reference color may be any of R, G, B, but G is desirable. An influence of G on a brightness of the display device 12 is large and when the ratio of G is, for example, less than 1 (one), it becomes easier to decrease the brightness of the display device 12 more largely.

Further, the color conversion table creation unit 221 creates the multi-dimensional LUT as the color conversion table based on the color signal ratio set by the ratio setting unit 219 in addition to the target value set by the target value setting unit 218. Further, the ratio of R', G', B' of the image data at the time when the input image data R, G, B is color-converted to the image data composed of R', G', B' using the multi-dimensional LUT created as described above becomes the color signal ratio set by the ratio setting unit 219. In other words, it may be described that when an input image is color-converted to a gray image, the color conversion table is created by the color conversion table creation unit 221 in such a manner that the color signal ratio is converted to a value set by the ratio setting unit 219.

As such, the multi-dimensional LUT of the present embodiment is created based on the first target value and the ratio (color signal ratio). Also, when the input image data is color-converted into the output image data using the multi-dimensional LUT, the gray image actually displayed on the display device 12 becomes an image which has hue and of which color is unified.

Figure 13:
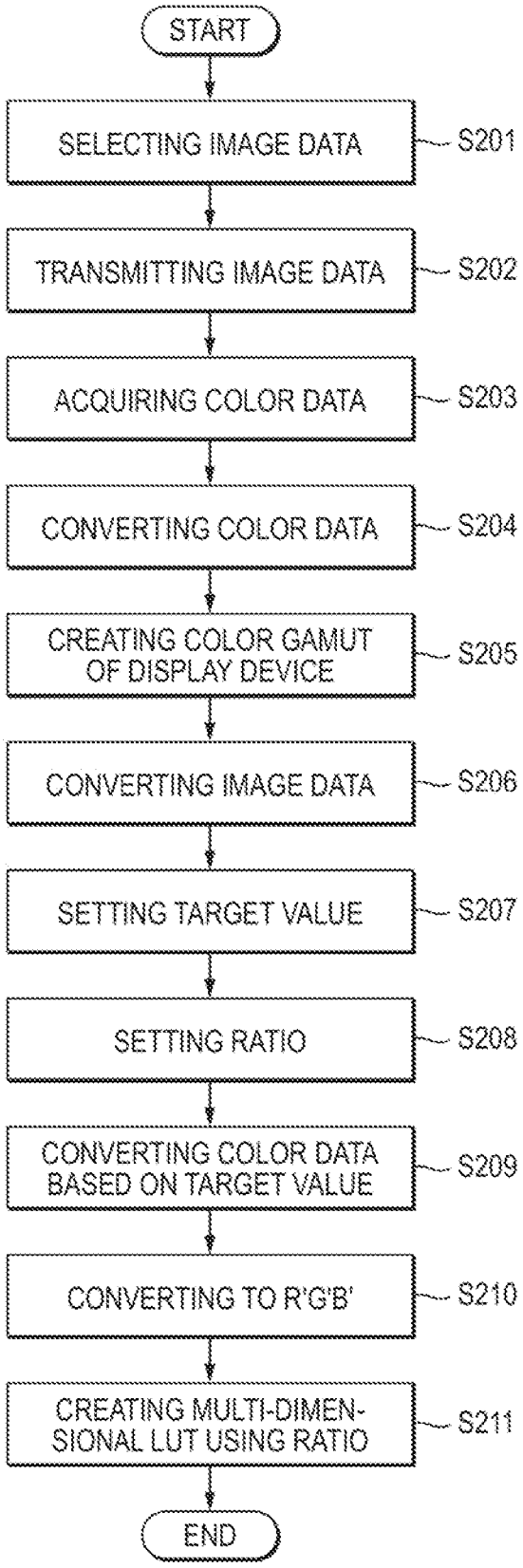
FIG. 13 is a flowchart explaining about operations of the PC for setting.
Figure 14:
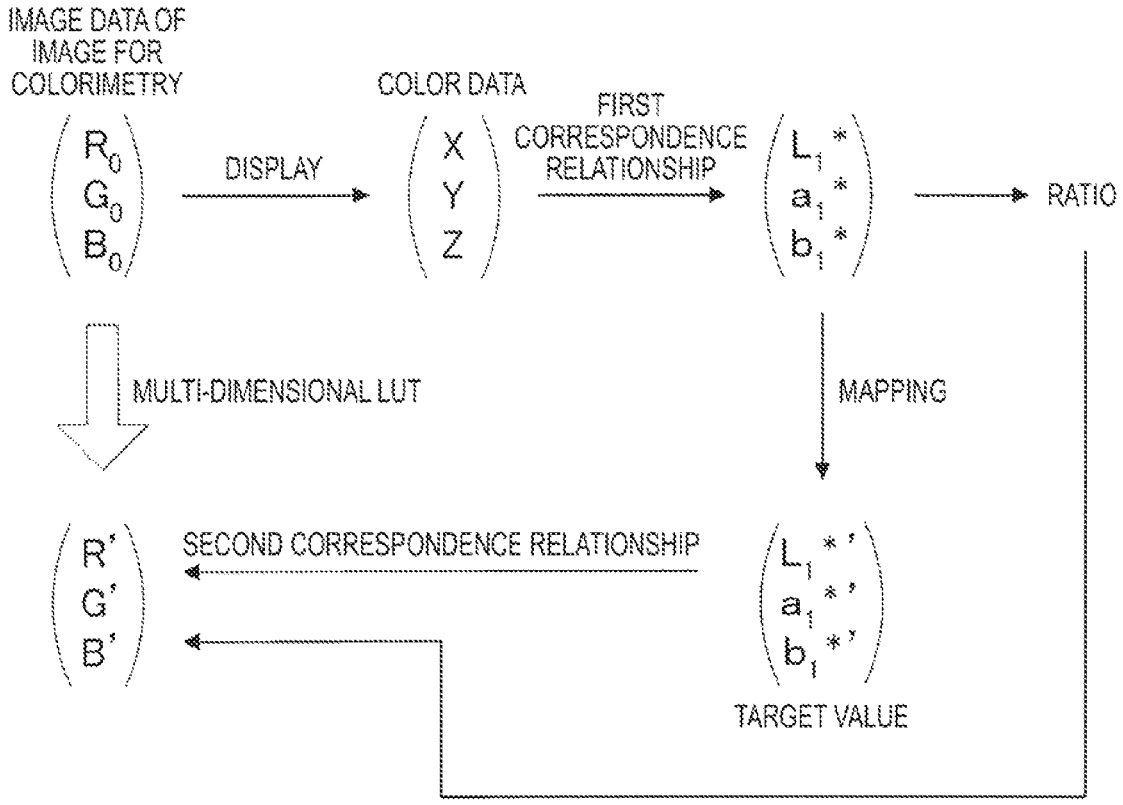
FIG. 14 is a view conceptually illustrating a procedural process in which a color value is converted.

Next, descriptions will be made on the operations of the PC 21 for setting in the present embodiment. FIG. 13 is a flowchart explaining about the operations of the PC 21 for setting. Further, FIG. 14 is a view conceptually illustrating a procedural process in which a color value is converted. Hereinafter, the operations of the PC 21 for setting will be described with reference to FIG. 11, FIG. 13 and FIG. 14.

Processings of step 201 to step 207 are the same as those of step 101 to step 107, respectively, and thus descriptions thereof will be omitted.

After step 207, the ratio setting unit 219 sets the color signal ratio to cause the color of the image to be displayed on the display device 12 to be unified based on $L_1$*, $a_1$*, $b_1$* that are the color data of the image for colorimetry (step 208).

Next, step 209 and step 210 are the same as step 108 and step 109. Also, the color conversion table creation unit 221 creates the multi-dimensional LUT as a color conversion table which converts the color of image displayed by the display device 12 (step 211). In this case, the color conversion table creation unit 221 creates the multi-dimensional LUT which converts the color of image displayed by the display device 12 using the color signal ratio.

The data of the created multi-dimensional LUT are stored as each lattice point data of the multi-dimensional LUT stored in the color conversion table storage unit 132 (see FIG. 1) of the color processing apparatus 13.

Figure 15A:
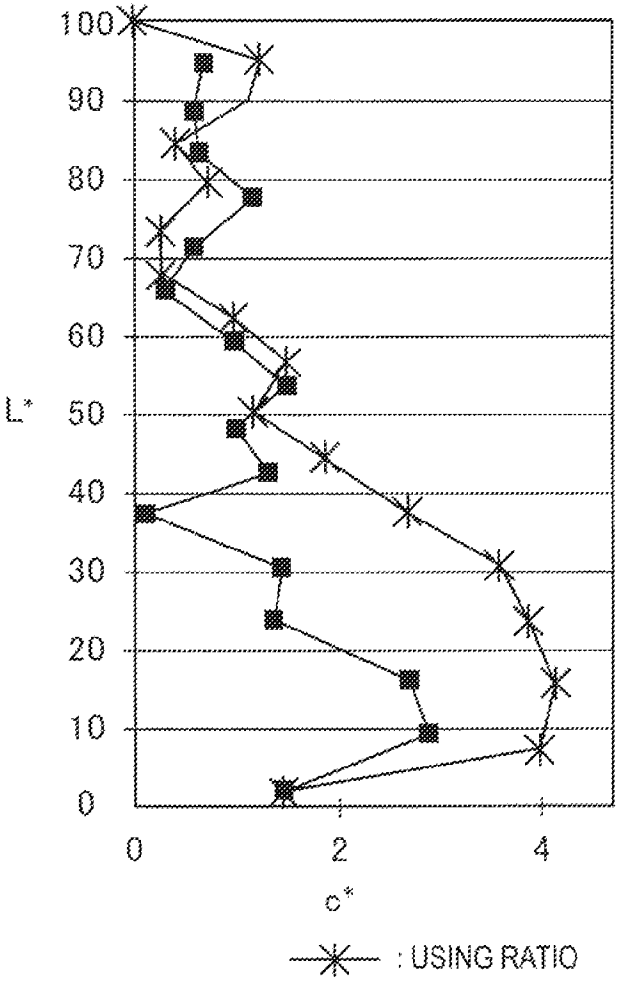
FIG. 15A and FIG. 15B are views in which a case where the gray image is converted by the mapping unit by setting the color signal ratio together with the first target value is compared with a case where the gray image is converted by the mapping unit using only the first target value without setting the color signal ratio as described above, when the image data to be displayed on the display device includes an gray image.
Figure 15B:
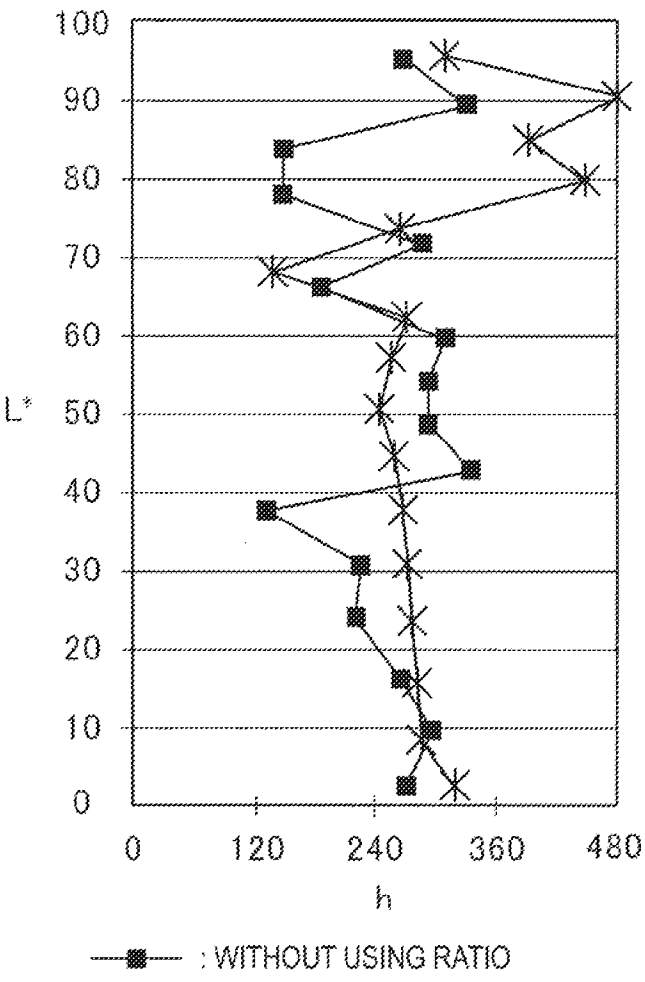

FIG. 15A and FIG. 15B are views in winch a case where the gray image is converted by the mapping unit by setting the color signal ratio together with the first target value is compared with a case where the gray image is converted by the mapping trait 220 using only the first target value without setting the color signal ratio as described above, when the image data to be displayed on the display device 12 includes an gray image. FIG. 15A illustrates a relationship between lightness and saturation. Here, the horizontal axis indicates saturation c* and the vertical axis indicates lightnessL*. Further, FIG. 15B illustrates a relationship between the lightness and the hue angle. Here, the horizontal axis indicates the hue angle h and the vertical axis indicates the lightnessL*.

As illustrated, conversion by setting the ratio that causes change in the saturation or the hue angle that occurs according to the change of lightness becomes smoother than conversion without setting the ratio gentle and thus, continuity of the saturation or the hue is improved.

Third Embodiment

Next, a third embodiment will be described as a functional configuration of the PC for setting.

The PC 21 for setting of the present embodiment has the same configuration as that of the PC 21 for setting illustrated in FIG. 11. Functional units illustrated have the same function as the PC 21 for setting illustrated in FIG. 11 of the second embodiment except for the target value setting unit 218. Accordingly, the target value setting unit 218 will be described below as the third embodiment.

The target value setting unit 218 sets the target value $L_1$*, $a_1$*, $b_1$*, for color reproduction at the time when displaying the image on the display devisee 12 based on each color value of the color data $L_1$*, $a_1$*, $b_1$*. However, similarly as in the first embodiment, two kinds of target values, that is, the first target value and the second target value are set in the present embodiment.

Accordingly, the multi-dimensional LUT created by the color conversion table creation unit 221 is created based on the target value (first target value and second target value) and ratio (color signal ratio). That is, the created multi-dimensional LUT is an LUT in which the second target value is reflected with respect to the second embodiment. Also, when the input image data is color-converted into the output image data using the multi-dimensional LUT, the gray image actually displayed on the display device 12 becomes an image which has hue and of which color is unified. Further, as in the present embodiment, when the color conversion is performed by combining creation of the color conversion table based on the second target value and creation of the color conversion table based on the color signal ratio set by the ratio setting unit 219, it is desirable to avoid the color conversion based on both the second target value and the color signal ratio from being performed with respect to the same (of the input image data) color value. That is, it is desirable to perform the color conversion based on either the second target value or the color signal ratio with respect to the same color value. In order to implement the desirable color conversion, in the present embodiment, the color conversion table is created based on the second target value in the high lightness region while the color conversion table is created based on the color signal ratio in the low lightness region and thus, the second target value and the color signal ratio are distinctively used so as not to perform a redundant color conversion with respect to the same color value.

As described with reference to FIG. 3A and FIG. 3B, when the gray image is displayed by the display device 12, the saturation c* tends to be easily changed in a large scale in the low lightness region and the hue angle h tends to be easily changed in a large scale in the high, lightness region. In this case, the color conversion table creation unit 221 may create the multi-dimensional LUT by reflecting the second target value in a case where the value of lightness contained in the color data falls within a predetermined high lightness region, while create the multi-dimensional LUT based on the color signal ratio in a case where the value of lightness contained in the color data falls within a predetermined low lightness region. This boundary of the lightness value may be set to lightness of 50 (fifty) when, for example, lightness in a case of displaying a white image by the display device 12 is set to lightness of 100 (one hundred). Further, this boundary may be changed according to the device characteristic of the display device 12. Further, the color signal ratio of the color signal of R, G, B illustrated in FIG. 12 may be set as each ratio at this boundary. In this case, continuity of saturation c* or the hue angle h may become easy to secure.

Further, a method may be considered in which the multi-dimensional LUT is further corrected using the color signal ratio after creating the multi-dimensional LUT by reflecting the second target value set by the target value setting unit 218. For example, when the color conversion is performed using the multi-dimensional LUT, a region in which the saturation c* or the hue angle h is changed in a relatively large scale according to lightness regarding the gray image. Also, the multi-dimensional LUT is former corrected using the color signal ratio regarding the region.

Further, the operations of the PC 21 for setting in the present embodiment are the same as those of FIG. 13 of the second embodiment. Further, a conceptual procedural process in which a color value is converted is the same as that illustrated in FIG. 14 of the second embodiment. There is a difference between the second embodiment and the third embodiment in that the multi-dimensional LUT of the second embodiment is created based on the first target value and the ratio (color signal ratio) while the multi-dimensional LUT of the third embodiment is created based on the first target value, the second target value and the ratio (color signal ratio), by adding the second target value in the second embodiment.

Figure 16A:
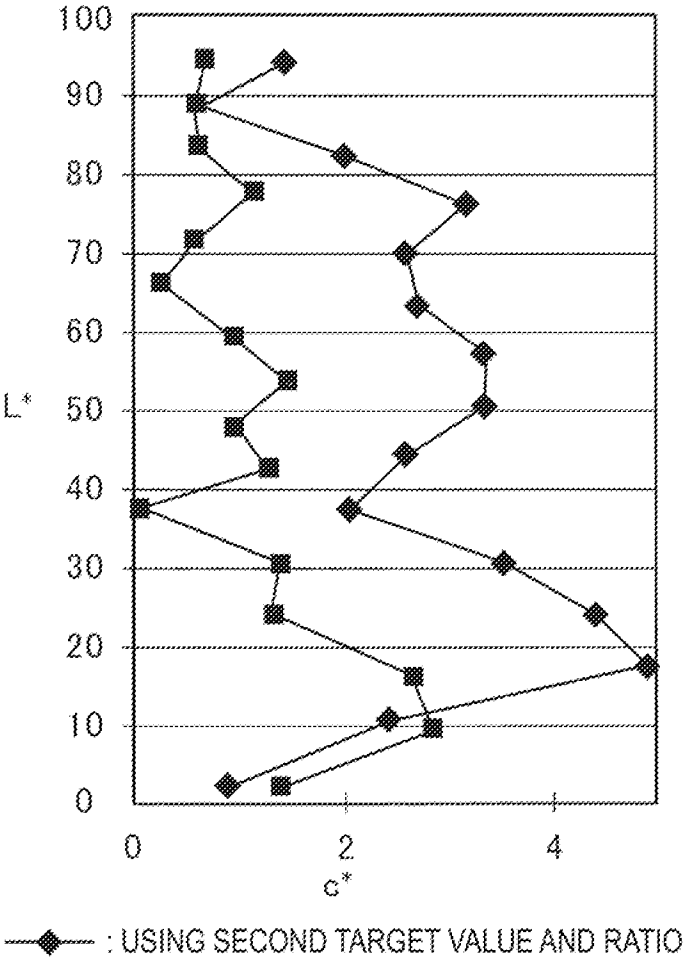
FIG. 16A and FIG. 16B are views in which a case where a multi-dimensional LUT is created using the color signal ratio in the low lightness region together with the second target value in a high lightness region is compared with a case where the multi-dimensional LUT is created without using the second target value and the color signal ratio, when the image data to be displayed on the display device includes an gray image.
Figure 16B:
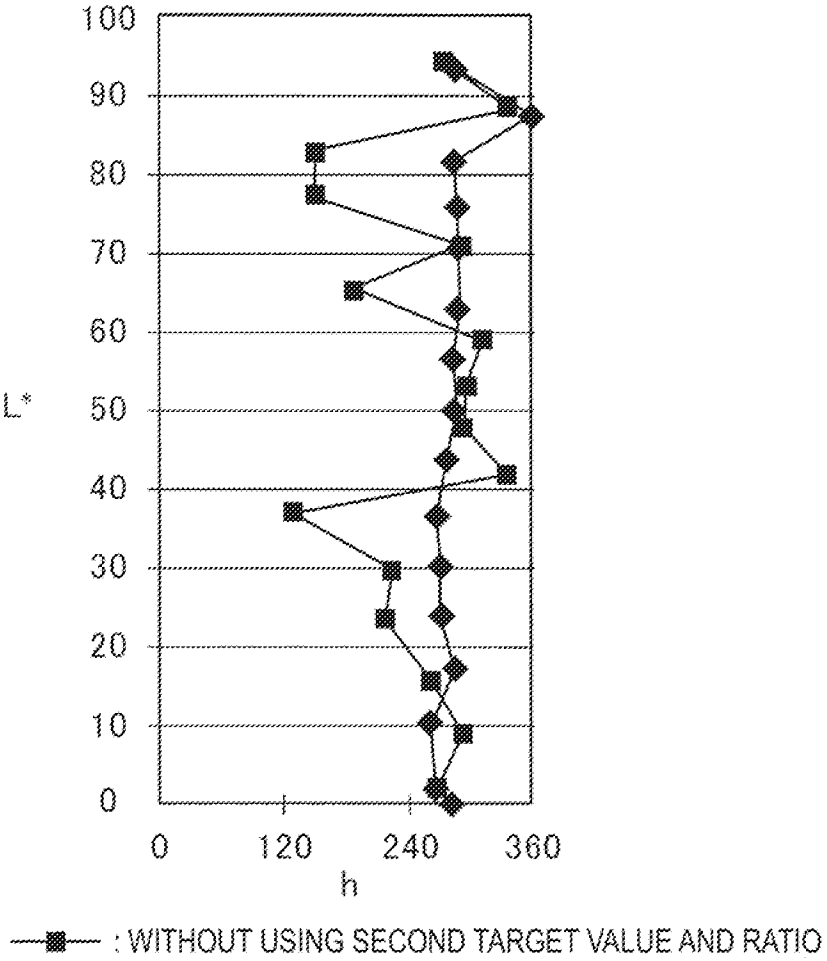

FIG. 16A and FIG. 16B are views in which a case where a multi-dimensional LUT is created using the color signal ratio in the low lightness region together with the second target value in a high lightness region is compared with a case where the multi-dimensional. LUT is created without using the second target value and the color signal ratio, when the image data to be displayed on the display device 12 includes an gray image. FIG. 16A illustrates a relationship between lightness and saturation. Here, the horizontal axis indicates saturation c* and the vertical axis indicates lightnessL*. Further, FIG. 16B illustrates a relationship between the lightness and the hue angle. Here, the horizontal axis indicates the hue angle h and the vertical axis indicates the lightnessL*. Further, in this case, the multi-dimensional LUT is created by reflecting the second target value in the high lightness region while the multi-dimensional LUT is created based on the color signal ratio in the low lightness region, by setting the lightnessL*=50 as the boundary, as described above.

As illustrated, variation in the hue angle h between the gray image groups having different lightness becomes smaller and change in saturation or the hue angle occurring according to change of lightness becomes gentle, in a case of a color conversion using the second target value and the color signal ratio compared to a case of a color conversion without using both the second target value and the color signal ratio and thus, continuity of the saturation or hue is improved.

The color processing apparatus 13 and the PC 21 for setting described above may be regarded as a color adjustment system which includes a color processing apparatus 13 which performs the color conversion processing on the image data created to display image by the display device 12 using the predetermined color conversion table to output the image data to the display device 12 as a color conversion module and a PC 21 for setting as the conversion relationship creation unit which creates the color conversion table used in the color processing apparatus 13.

Further, in the image display system 10 of the present embodiment, the color processing apparatus 13 is disposed between the PC 11 for displaying and the display device 12, as a separate member from these PC 11 for displaying and the display device 12, but the image display system 10 is not limited thereto. For example, functions of the color processing apparatus 13 may be equipped in the PC 11 for displaying and also equipped in the display device 12.

Further, in the present embodiment, the PC 21 for setting is a separate member from the PC 11 for displaying but the function of the PC 21 for setting may be provided in the PC 11 for displaying. In this case, the PC 11 for displaying functions as the conversion relationship creation unit (image processing apparatus).

<Description of Program>

Here, the process performed by the PC 21 for setting in the present embodiment as described above is prepared as a program, for example, application software as described above.

Accordingly, in the first to third embodiments, the process performed by the PC 21 for setting may be regarded as a program that, when executed, causes a computer to implement setting the target value for color reproduction at the time of displaying image on the display device 12 and creating a conversion relationship used when performing the color conversion on the image to be displayed on the display device 12 based on the set target value, and includes the first target value set based on the device characteristic of the display device 12 as the target value and the second target value in which the saturation and hue of the gray image are designated.

Further, the process performed by the color processing apparatus 13 may be regarded as a program that, when executed, causes a computer to implement performing the color conversion on the image be displayed on the display device 12 using the conversion relationship and the conversion relationship is created based on a target value containing the first target value set based on the display characteristic of the display device 12 and the second target value in which the saturation and hue of the gray image are designated, as the target value of the color reproduction at the time of displaying the image on the display device 12.

Further, the program implementing the present embodiment may be provided using a communication measures and also may be provided by being stored in a recording medium such as a CD-ROM.

While description has been made on the present embodiment, a technical scope of the present invention is not limited to the scope described in the embodiments. It is apparent that various modifications or improvements of the embodiments also included in the technical scope of the present invention from matters disclosed in claims.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A conversion apparatus, comprising:

at least one processor that functions as a target value setting unit that sets a target value for color reproduction at the time when output image data is displayed on a display device, the target value is set by using a first target value set based on a display characteristic of the display device and a second target value set by designating targets of hue and saturation with respect to a gray image, and the target value is obtained based on color data of an image for colorimetry displayed on the display device;

a conversion relation creation unit that creates a conversion relation based on the set target value; and an output image creation unit that performs color conversion processing on an input image data using the conversion relation to creates the output image data, wherein the second target value is set to suppress variation of color representation when the input image data indicates the gray image and color conversion processing is performed on the input image data using only the first target value.

2. The conversion relationship creation apparatus of claim 1, wherein the second target value is set such a color of the gray image to be displayed on the display device becomes one of red, green and blue.

3. The conversion relationship creation apparatus of claim 1, wherein the second target value is designated as values of saturation and hue angle in such a manner that the saturation is designated to be a value greater than zero and the hue angle is designated to be an identical value.

4. The conversion relationship creation apparatus of claim 1, wherein a value of the saturation designated as the second target value is designated to be increased from a first lightness value, which is the maximum value of lightness, toward a second lightness value having a smaller lightness than the first lightness value.

5. The color conversion apparatus of claim 1, wherein the color conversion is performed such that the hue angle of the gray image is restricted to be fallen within one of a first region spanning from 0 degree to 90 degrees, a second region spanning from 90 degrees to 180 degrees and a third region spanning from 180 degrees to 360 degrees.

6. The color conversion apparatus of claim 1, wherein the conversion relation is applied when a value of lightness contained in the input image data falls within a predetermined high lightness region.

7. A non-transitory computer readable medium storing a program causing a computer to execute a process for color conversion, the process comprising:

setting a target value for color reproduction at the time when output image data is displayed on a display device, the target value is set by using a first target value set based on a display characteristic of the display device and a second target value set by designating targets of hue and saturation with respect to a gray image, and the target value is obtained based on color data of an image for colorimetry displayed on the display device;

creating a conversion relation based on the set target value; and performing color conversion processing on an input image data using the conversion relation to creates the output image data, wherein the second target value is set to suppress variation of color representation when the input image data indicates the gray image and color conversion processing is performed on the input image data using only the first target value.

8. A conversion apparatus, comprising:

at least one processor that functions as a target value setting unit that sets a target value for color reproduction at the time when output image data is displayed on a display device, the target value is set by using a first target value set based on a display characteristic of the display device, and the target value is obtained based on color data of an image for colorimetry displayed in the display device;

a conversion relation creation unit that creates a conversion relation based on the set target value; and an output image creation unit that performs color conversion processing on an input image data using the conversion relation to creates the output image data, wherein the conversion relation is created for performing the color conversion processing on the input image data to have color signal ratio other than 1:1:1 so as to suppress variation of color representation when the input image data indicates the gray image and color conversion processing is performed on the input image data using only the first target value.

9. The conversion relationship creation apparatus of claim 8, wherein the second target value is set such a color of the gray image to be displayed on the display device becomes one of red, green and blue.

10. The color conversion apparatus of claim 8, wherein the conversion relation is applied when a value of lightness contained in the input image data falls within a predetermined low lightness region.

11. A non-transitory computer readable medium storing a program causing a computer to execute a process for color conversion, the process comprising:

setting a target value for color reproduction at the time when output image data is displayed on a display device, the target value is set by using a first target value set based on a display characteristic of the display device, and the target value is obtained based on color data of an image for colorimetry displayed on the display device;

creating a conversion relation based on the set target value; and performing color conversion processing on an input image data using the conversion relation to creates the output image data, wherein the conversion relation is created for performing the color conversion processing on the input image data to have color signal ratio other than 1:1:1 so as to suppress variation of color representation when the input image data indicates the gray image and color conversion processing is performed on the input image data using only the first target value.

* * * * *